US008316561B2

(12) United States Patent
Jia

(10) Patent No.: US 8,316,561 B2
(45) Date of Patent: Nov. 27, 2012

(54) LACE AND TOUNGUE CONFIGURATION

(76) Inventor: Juncheng Jia, Diamond Bar, CA (US)

( * ) Notice: Subject to any disclaimer, the term of this patent is extended or adjusted under 35 U.S.C. 154(b) by 951 days.

(21) Appl. No.: 12/287,578

(22) Filed: Oct. 10, 2008

(65) Prior Publication Data

US 2010/0088925 A1 Apr. 15, 2010

(51) Int. Cl.
*A43C 11/00* (2006.01)
*A43B 23/26* (2006.01)

(52) U.S. Cl. ..... 36/50.1; 36/51; 36/54

(58) Field of Classification Search ..... 36/50.1, 36/51, 54; 24/712, 713.4
See application file for complete search history.

(56) References Cited

U.S. PATENT DOCUMENTS 6,094,841 A * 8/2000 Adams ..... 36/99
6,810,604 B2 * 11/2004 Chen et al. ..... 36/14
6,823,610 B1 * 11/2004 Ashley ..... 36/54
6,839,986 B2 * 1/2005 Chen et al. ..... 36/54
7,552,547 B2 * 6/2009 Calderone ..... 36/50.1
7,624,518 B2 * 12/2009 Calderone ..... 36/50.1
7,877,901 B2 * 2/2011 Calderone ..... 36/50.1

* cited by examiner

*Primary Examiner* — Jila M Mohandesi
*Assistant Examiner* — Sharon M Prange
(74) *Attorney, Agent, or Firm* — Anthony King

(57) ABSTRACT

The present invention uses a particular configuration of intermediate stitches between eyelets and elastic connection to provide supplemental support for shoelaces. The intermediate stitches also called inter eyelet stitches provide connection between the shoe and a tongue for supplemental support. The elastic connection additionally provides connection between the shoe and the tongue. The laces having received the stitch support can then be omitted, or styled in a variety of different configurations according to fashion requirements. The intermediate stitches preferably are placed between the third and fourth eyelet, between the first and second eyelet, and below the first eyelet. The elastic connection is preferably configured by the top eyelet also called the fifth eyelet connecting to the tongue.

14 Claims, 6 Drawing Sheets

LACE AND TOUNGUE CONFIGURATION

DISCUSSION OF RELATED ART

Shoes traditionally use laces to fasten the shoe. Laces interweave through eyelets over a tongue for fastening a shoe. The tongue is traditionally attached to the toe of the shoe resting against the top of a person's foot and held by laces. A number of lace fastening means have been devised by persons such as fashion minded teenagers for changing the look of the shoe. Some of these lace fastening means are not as structurally sound as the traditional overlapping lace configuration. Laces also have the drawback that they can come undone, or neglected.

While some shoes do not require laces, such as by substitution with hook and loop tape, laces have become a standard part of the fashion of the shoe industry. Therefore, total omission of laces is also not preferable.

SUMMARY OF THE INVENTION

The present invention uses a particular configuration of intermediate stitches between eyelets and elastic connection to provide supplemental support for shoelaces. The intermediate stitches also called inter eyelet stitches provide connection between the shoe and a tongue for supplemental support. The elastic connection additionally provides connection between the shoe and the tongue. The laces having received the stitch support can then be omitted, or styled in a variety of different configurations according to fashion requirements. The intermediate stitches preferably are placed between the third and fourth eyelet, between the first and second eyelet, and below the first eyelet. The elastic connection is preferably configured by the top eyelet also called the fifth eyelet connecting to the tongue.

The following callout list of the present invention is used in the figures.

21 Bottom Connection
22 Top Connection
30 Tongue
31 Label
32 Lace Panel
35 First Inter Eyelet Stitch
36 Second Inter Eyelet Stitch
37 Third Inter Eyelet Stitch
38 Top Of Lace Panel
39 Outside Panel Stitch
41 First Eyelet
42 Second Eyelet
43 Third Eyelet
44 Fourth Eyelet
45 Fifth Eyelet
51 Lace End
53 Lace
65 Elastic Connection
93 Inside Panel Stitch

DETAILED DESCRIPTION

Figure 1:
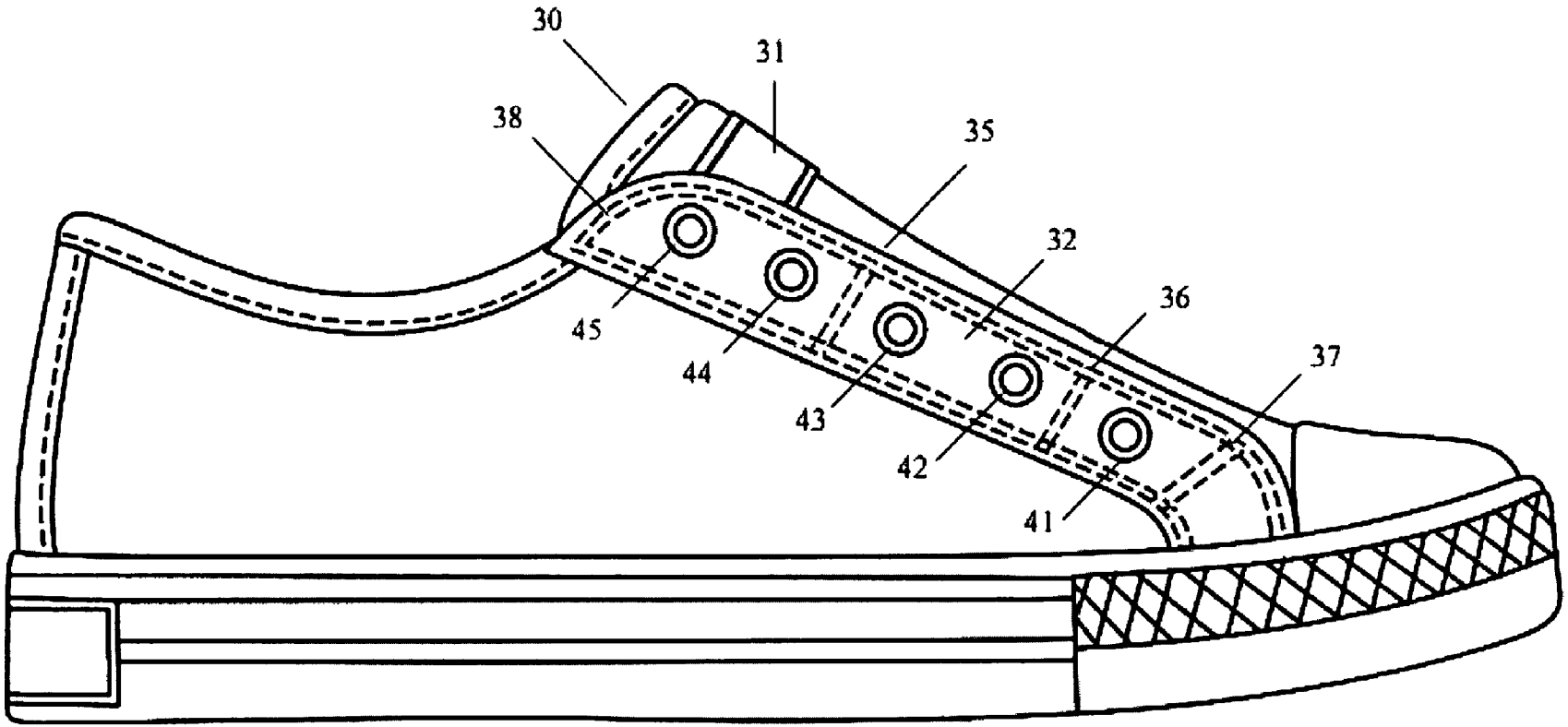
FIG. 1 is a side view of the present invention without laces.

The side view of the present invention without laces as shown in FIG. 1 depicts a regular shoe with a heel, a toe, a tongue 30 with a label 31 and a sole. Additionally, five eyelets are disposed on the lace panel 32 of the shoe. The five eyelets are typically grommet circular openings with the grommet having an inside portion and an outside portion secured together over cloth. The front toe portion of shoe typically overlaps the cloth upper portion.

The eyelets begin behind the toe with the first eyelet 41, second eyelet 42, third eyelet 43, fourth eyelet 44, and fifth eyelet 45 disposed sequentially in linear fashion on the panel 32. Between the eyelets, stitches secure the panel to the tongue of the shoe. The panel is stitched to the shoe upper which is above the shoe sole. The intermediate stitches preferably are placed between the third 43 and fourth 44 eyelet, between the first 41 and second 42 eyelet, and below the first eyelet 41. The elastic connection 65 is preferably configured by the top eyelet 45 also called the fifth eyelet 45 connecting to the tongue 30. The panel is elongated and generally rectangular which is curved at certain sections such as the top of the lace panel 38 which has a curvature toward the shoe upper. The first inter eyelet stitch 35 is preferably between the third and fourth eyelet and the second inter eyelet stitch 36 is preferably between the first and second eyelet. The third inter eyelet stitch is between the first eyelet 41 the bottom connection 21.

Figure 2:
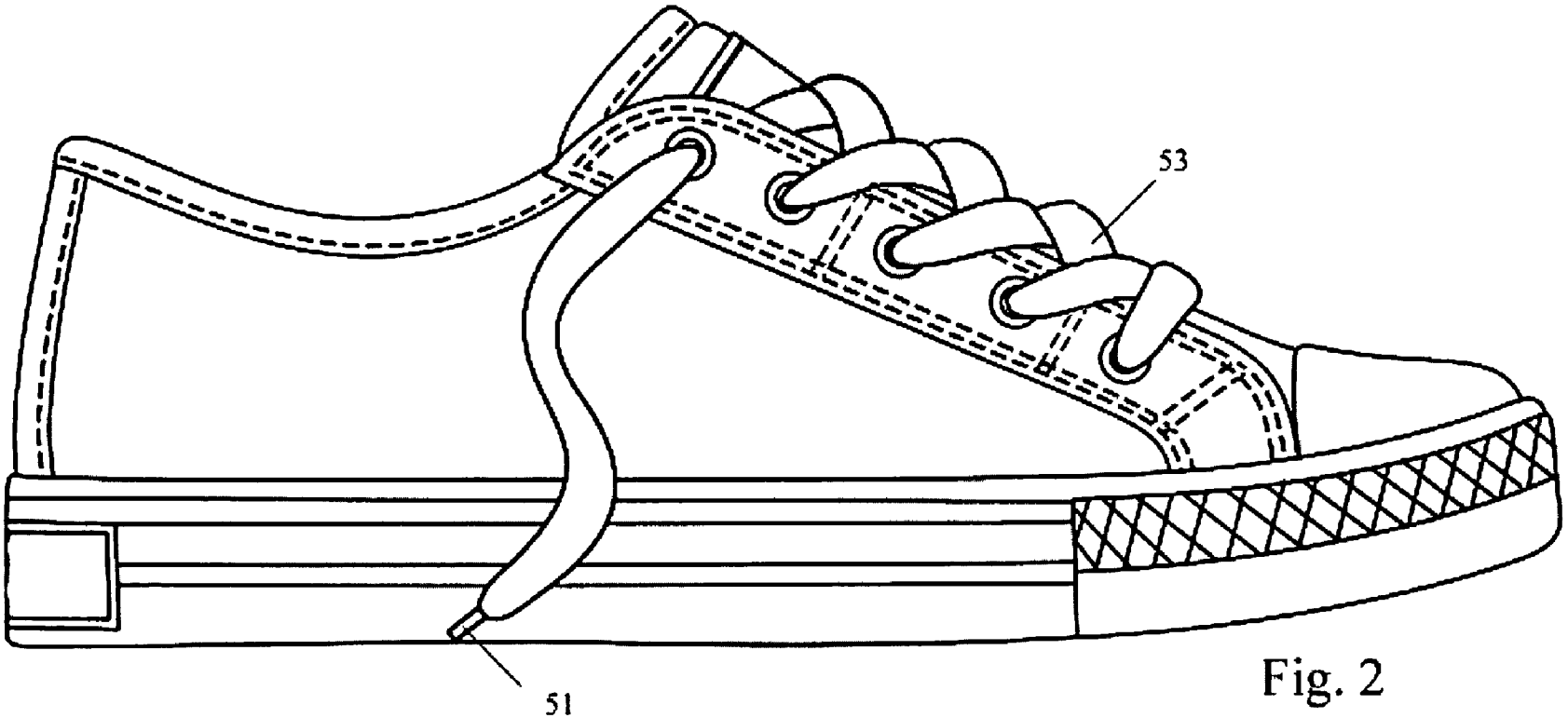
FIG. 2 is a side view of the present invention with laces.

After laces 53 are typically installed as seen in FIG. 2, the lace ends 51 extend from the top fifth eyelet 45. Typically, the laces 53 are weaved through the eyelets in alternating fashion entering from below the eyelets to exit and pass over the top of the eyelets terminating at a knot. There are a pair of lace panels 32.

Figure 3:
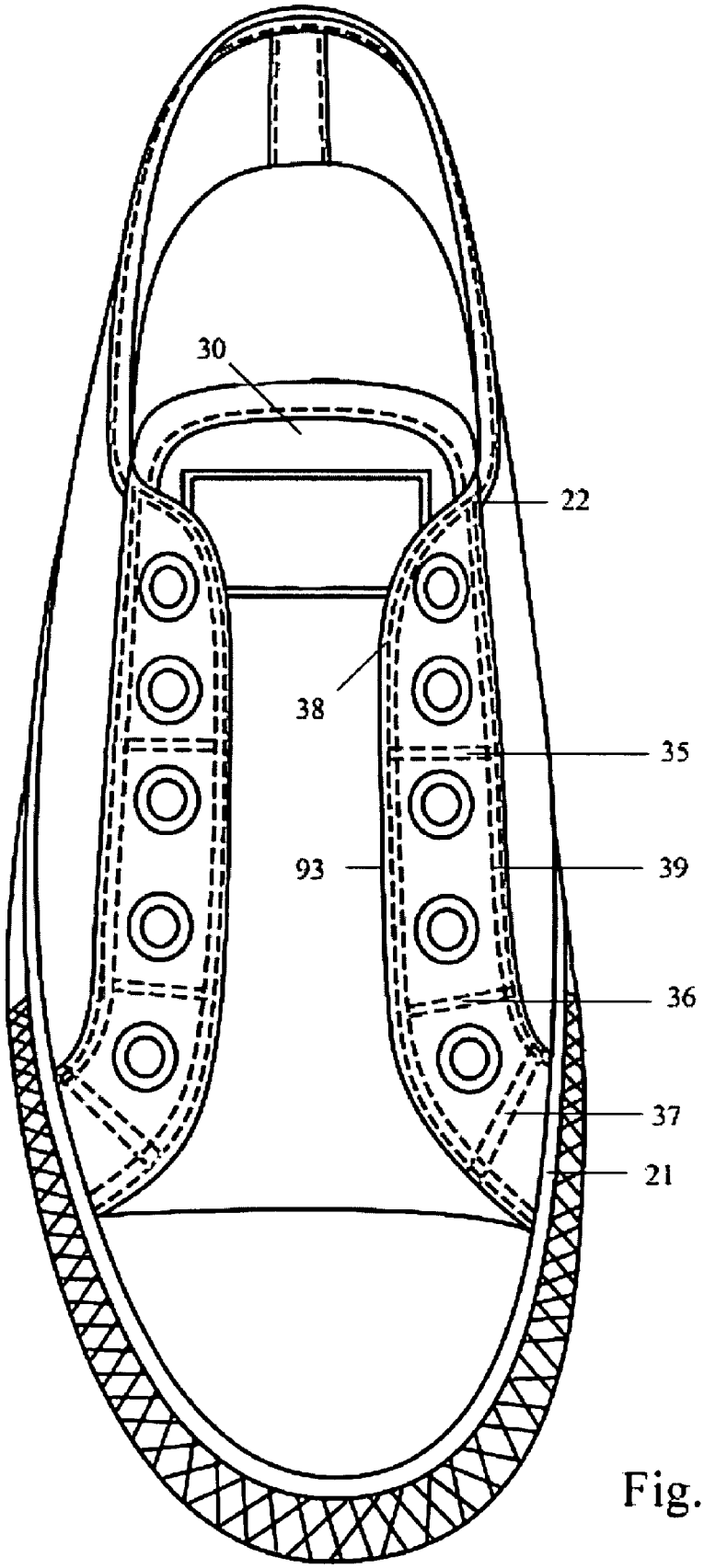
FIG. 3 is a front view of the present invention without laces.

A front view of the present invention without laces installed shows that the panels rest over the tongue 30 with a top connection 22 defining and upper edge of the lace panel 32 so that the top of the lace panel 38 has an inside panel stitch 93 and an outside panel stitch 39 running approximately parallel along the periphery of the panels as seen in FIG. 3. The first inter eyelet stitch 35 passes from the inside panel stitch 93 to the outside panel stitch 39. The second inter eyelet stitch 36 passes from the inside panel stitch 93 to the outside panel stitch 39. Similarly, the third inter eyelet stitch 37 passes between the inside panel stitch 93 to the outside panel stitch 39.

Figure 4:
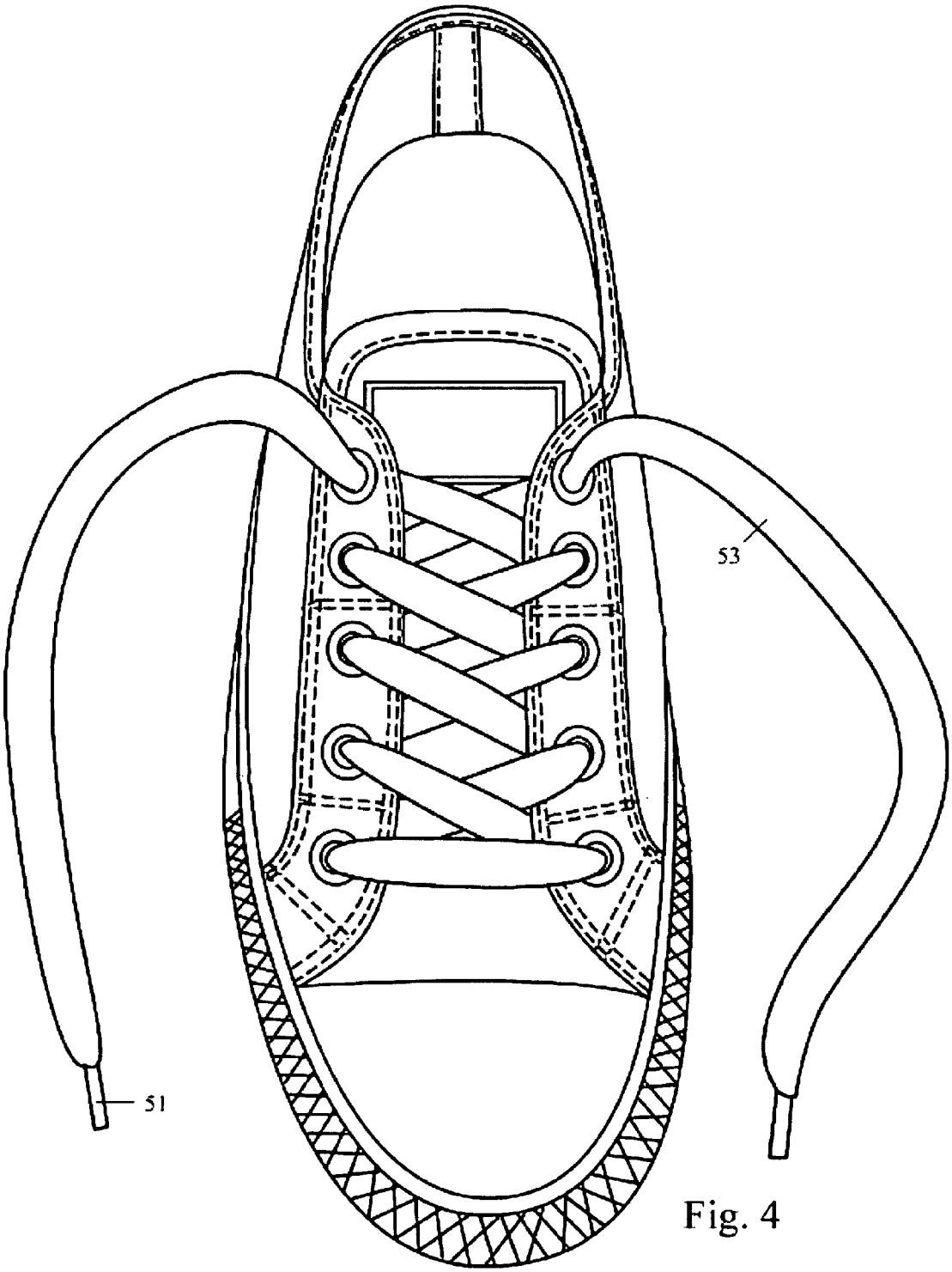
FIG. 4 is a front view of the present invention with laces.

When the laces are installed into the typical configuration, the stitches passing between the eyelets also passed between the laces. Again, the tips of the laces 51 can extend away from the laces 53, as shown in FIG. 4.

Figure 5:
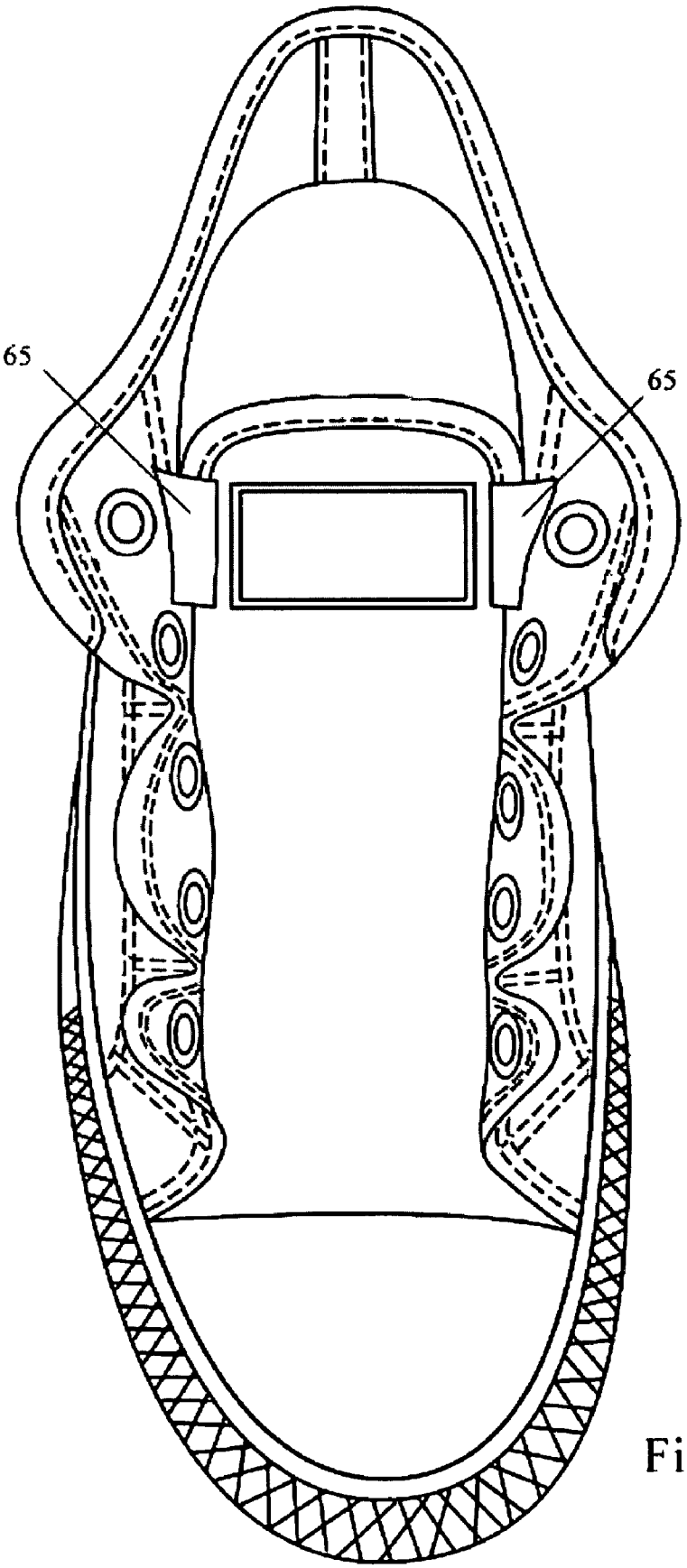
FIG. 5 is a front view of the present invention without laces in open configuration.

In an open configuration as seen in FIG. 5, where the shoe lace-panel is stretched outward for receiving a shoe lace 53, the present configuration displays a pair of elastic connection 65 at the top of the tongue 30. The elastic connection is made of a strip of elastic material. The strip of elastic material may be a single strip passing from one side of the tongue to the other side underneath the label. Alternatively, the strip of elastic material could be made of a pair of strips, each attached to the area between the tongue and the fifth eyelet 45. The elastic band type of material is attached to the shoe upper by the outside panel stitch 39 which stitches the panel to the shoe upper as well as stitching the elastic connection 65 to the tongue 30. A pair of slots on either side of the label provides a passageway for allowing the passage of the strip of elastic material between the label and tongue. Therefore, the strip of elastic material is in between the label and the tongue 30. The elastic member can be a strip of elastic material, or cord or lose stitching connecting the tongue to the shoe upper at a left and right edge of the tongue, such as that shown in the figure being the elastic member. The elastic member must passes through a passage which can be called an elastic material passage, or an elastic member passage.

The open configuration provides three regions of eyelet grouping, beginning with a lower region at a bottom with a single first eyelet 41, followed by a middle region in the middle with the second eyelet 42 and the third eyelet 43, and followed by an upper region having the fourth eyelet 44 and the fifth eyelet 45. The regions are segmented by the inter eyelet stitches. Besides the inter-eyelet stitches, the tongue is not otherwise connected to the shoe upper.

Figure 6:
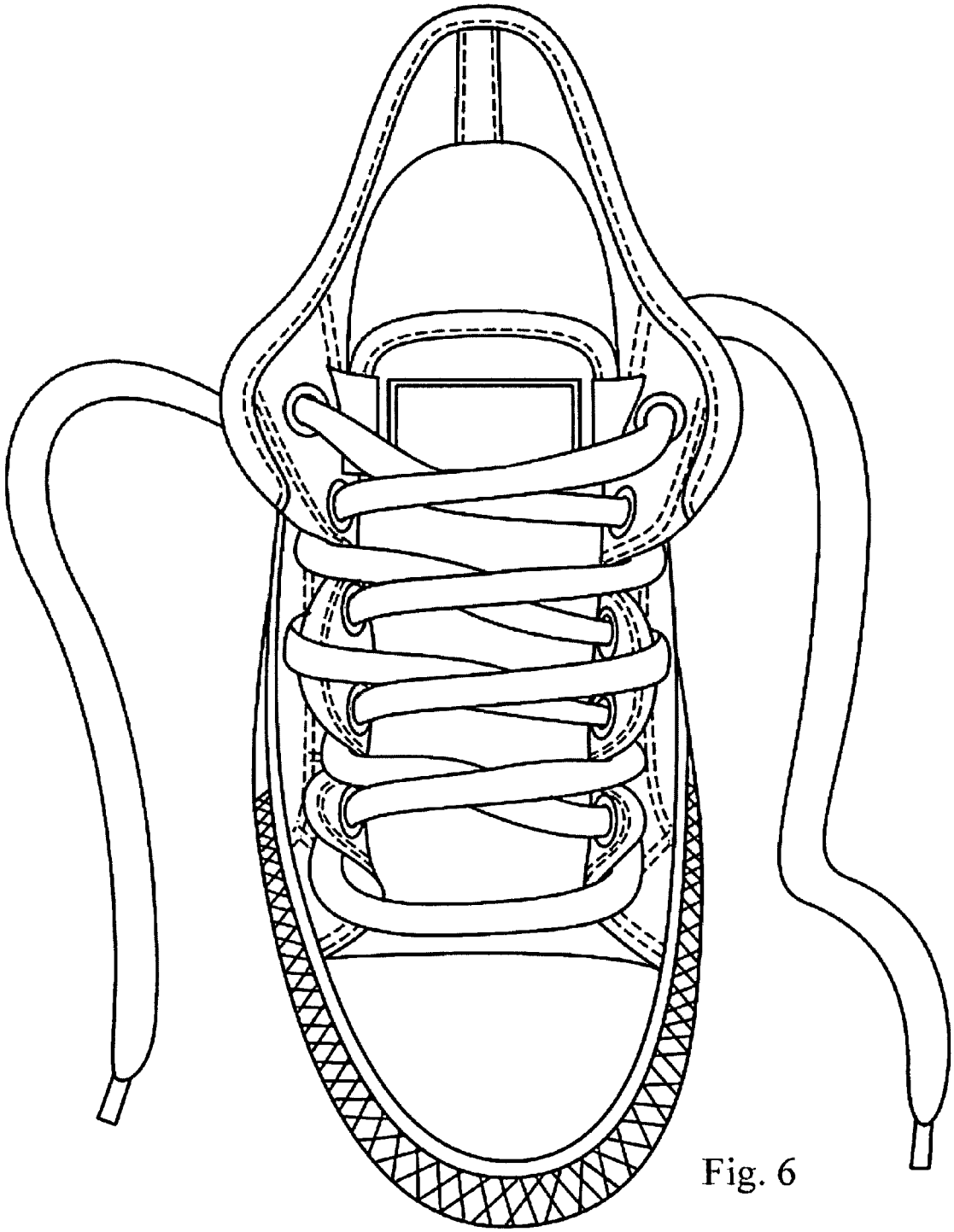
FIG. 6 is a front view of the present invention with laces in open configuration.

The open configuration with laces, as seen in FIG. 6, provides for a variety of imaginative lace configurations besides the traditional one shown in the figure. Each of the pair of lace panels is connected to the shoe upper at the outside panel stitch 39.

The invention claimed is:

1. A shoe lace and tongue configuration comprising:

a. a shoe upper connected to a sole;

b. a pair of lace panels each having a width, a length, and a longitudinal axis along the length of each of said pair of lace panels;

c. a tongue, which is elongated and connected to the shoe upper at a tongue lower portion at a distal end of the tongue;

d. a pair of plurality of eyelets formed as grommet connections on the pair of lace panels respectively, wherein the eyelets have a plurality of spacing between them;

e. at least one line of inter eyelet stitches disposed on a distal section of each lace panel and each line of inter eyelet stitches oriented substantially perpendicular to the longitudinal axis of each perspective lace panel, and each line of inter eyelet stitches spanning across the width of each perspective lace panel extending to an edge of each perspective lace panel, said distal section of each lace panel is defined as a portion of the lace panel from a distal end of the lace panel to a third eyelet counting from said distal end, wherein the at least one line of inter eyelet stitches directly stitches onto the tongue; and f. an elastic member connecting the tongue to the shoe upper at a left and right portion of the tongue, and wherein the tongue remains substantially free from connecting with the pair of lace panels except at the at least one line of inter eyelet stitches, and except by said elastic member;

g. a lace installed through each of the plurality of eyelets.

2. The shoe lace and tongue configuration of claim 1, wherein there are at least five eyelets, namely a first eyelet, a second eyelet, a third eyelet, a fourth eyelet and a fifth eyelet.

3. The shoe lace and tongue configuration of claim 1, wherein there are at least four eyelets on each lace panel, namely a first eyelet, a second eyelet, a third eyelet, and a fourth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet.

4. The shoe lace and tongue configuration of claim 1, wherein there are at least five eyelets on each lace panel, namely a first eyelet, a second eyelet, a third eyelet, a fourth eyelet, and a fifth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet.

5. The shoe lace and tongue configuration of claim 4, further comprising a third inter eyelet stitch between the first eyelet and a bottom connection where the shoe upper and lace panel join to the sole.

6. The shoe lace and tongue configuration of claim 1, further comprising a label on the tongue.

7. The shoe lace and tongue configuration of claim 6, wherein there are at least five eyelets, namely a first eyelet, a second eyelet, a third eyelet, a fourth eyelet and a fifth eyelet.

8. The shoe lace and tongue configuration of claim 6, wherein there are at least four eyelets on each lace panel, namely a first eyelet, a second eyelet, a third eyelet, and a fourth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet.

9. The shoe lace and tongue configuration of claim 6, wherein there are at least five eyelets on each lace panel, namely a first eyelet, a second eyelet, a third eyelet, a fourth eyelet, and a fifth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet.

10. The shoe lace and tongue configuration of claim 9, further comprising a third inter eyelet stitch between the first eyelet and a bottom connection where the shoe upper and lace panel join to the sole.

11. The shoe lace and tongue configuration of claim 1, further comprising a label on the tongue, further comprising a pair of slots to the left and right of the label defining an elastic member passage, wherein the elastic member passes underneath the label and is connected to the shoe upper at an elastic member left end and an elastic member right end.

12. The shoe lace and tongue configuration of claim 11, wherein there are at least five eyelets, namely a first eyelet, a second eyelet, a third eyelet, a fourth eyelet and a fifth eyelet.

13. The shoe lace and tongue configuration of claim 11, wherein there are at least four eyelets on each lace panel, namely a first eyelet, a second eyelet, a third eyelet, and a fourth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet.

14. The shoe lace and tongue configuration of claim 11, wherein there are at least five eyelets on each lace panel, namely a first eyelet, a second eyelet, a third eyelet, a fourth eyelet, and a fifth eyelet, wherein there are at least two inter eyelet stitches, namely a first inter eyelet stitch and a second inter eyelet stitch, wherein the first inter eyelet stitch is between the first and second eyelet and wherein the second inter eyelet stitch is between the third and fourth eyelet; and further comprising a third inter eyelet stitch between the first eyelet and a bottom connection where the shoe upper and lace panel join to the sole.

* * * * *